US011629526B2

(12) United States Patent
Lee et al.

(10) Patent No.: US 11,629,526 B2
(45) **Date of Patent: *Apr. 18, 2023**

(54) WIRELESS ELECTRIC STRIKE

(71) Applicant: Nexkey, Inc., San Mateo, CA (US)

(72) Inventors: Chi (Ricky) Lee, San Francisco, CA (US); William J. Rehlich, San Francisco, CA (US); Peter R. Russo, Oakland, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/549,835

(22) Filed: Dec. 13, 2021

(65) Prior Publication Data

US 2022/0170295 A1 Jun. 2, 2022

Related U.S. Application Data

(63) Continuation of application No. 16/298,997, filed on Mar. 11, 2019, now Pat. No. 11,248,397.

(60) Provisional application No. 62/641,130, filed on Mar. 9, 2018.

(51) Int. Cl.
*E05B 47/00* (2006.01)
*G07C 9/00* (2020.01)

(52) U.S. Cl.
CPC ..... *E05B 47/0046* (2013.01); *G07C 9/00174* (2013.01); *E05B 2047/0091* (2013.01); *G07C 2009/00642* (2013.01)

(58) Field of Classification Search
CPC .. G06T 5/50; G05B 15/02; H04B 1/00; H04L 9/14; E05B 47/00
USPC ..... 340/5.24, 5.2, 5.22, 5.7, 5.73, 5.61; 70/278.7, 218; 292/341, 340, 341.14
See application file for complete search history.

(56) References Cited

U.S. PATENT DOCUMENTS

| | | | |
|---|---|---|---|
| 4,867,496 | A | 9/1989 | Thomas |
| 5,118,150 | A | 6/1992 | Jarrett |
| 5,990,579 | A | 11/1999 | Ricci |
| 6,043,753 | A | 3/2000 | Okayasu et al. |
| 6,595,563 | B2 | 7/2003 | Kiernan |
| 6,874,830 | B2 | 4/2005 | Bashford |
| 6,935,663 | B2 | 8/2005 | Schildwachter et al. |
| 7,042,332 | B2 | 5/2006 | Takamura et al. |
| 7,669,902 | B2 | 3/2010 | Orbeta |
| 8,366,160 | B2 | 2/2013 | Orbeta et al. |
| 8,516,864 | B2 | 8/2013 | Greiner et al. |
| 8,544,895 | B2 | 10/2013 | Webb et al. |
| 8,643,468 | B1 | 2/2014 | Peabody et al. |
| 8,807,606 | B2 | 8/2014 | Ross et al. |

(Continued)

OTHER PUBLICATIONS

HES—A Complete Guide To Electric Strikes, AHS hes, Oct. 2013, p. 1-13, An ASSA ABLOY Group Company Guide, accessed Feb. 21, 2018.

(Continued)

*Primary Examiner* — Nam V Nguyen
(74) *Attorney, Agent, or Firm* — RosserIP, LLC; Roy Rosser

(57) ABSTRACT

Various implementations of an electric strike are described that includes a casing housing that includes a power source, a lock mechanism, circuitry powered by the power source, the circuitry being configured to authenticate a user, and electro-mechanically actuate the lock mechanism, and a rotor coupled to the lock mechanism, the rotor being powered by the power source and configured to situate the lock mechanism based on a lock state of the electric strike.

16 Claims, 7 Drawing Sheets

(56) References Cited

U.S. PATENT DOCUMENTS

| | | | | |
|---|---|---|---|---|
| 8,833,814 | B2 | 9/2014 | Chang | |
| 9,580,935 | B2 | 2/2017 | Singh | |
| 9,657,501 | B2 | 5/2017 | Armari et al. | |
| 9,945,153 | B2 * | 4/2018 | Scheffler | E05B 15/022 |
| 10,301,847 | B2 | 5/2019 | Snodgrass | |
| 10,794,088 | B2 * | 10/2020 | Sims | E05B 47/0047 |
| 10,934,744 | B2 * | 3/2021 | Sims | E05B 47/0047 |
| 11,248,397 | B2 * | 2/2022 | Lee | E05B 47/0047 |
| 2004/0061343 | A1 | 4/2004 | Bashford | |
| 2009/0188289 | A1 | 7/2009 | Orbeta | |
| 2010/0096864 | A1 | 4/2010 | Webb et al. | |
| 2010/0116006 | A1 | 5/2010 | Huang | |
| 2010/0127518 | A1 | 5/2010 | Huang | |
| 2015/0284976 | A1 | 10/2015 | Singh | |

OTHER PUBLICATIONS

Wikipedia, Electric Strike, p. 1-2, https://en.wikipedia.org/wiki/Electric_strike, accessed Feb. 22, 2018.

* cited by examiner

WIRELESS ELECTRIC STRIKE

CROSS-REFERENCE TO RELATED APPLICATIONS

The present application is a continuation of U.S. patent application Ser. No. 16/298,997, entitled "Wireless Electric Strike," filed on Mar. 11, 2019, now U.S. Pat. No. 11,248,397, issued Feb. 15, 2022, which claims the benefit under 35 U.S.C. § 119(e) of U.S. Provisional Patent Application Ser. No. 62/641,130, entitled "Wireless Electric Strike," filed on Mar. 9, 2018, the entire contents of which are incorporated by reference.

TECHNICAL FIELD

The present disclosure relates to lock mechanisms.

BACKGROUND

Today's use of electric strikes is generally motivated by their flexibility, ease of use, and other advantages that they have over conventional fixed strikes. However, existing electric strikes having a number of limitations that have yet to be addressed.

For instance, existing electric strikes are bulky/large in size and are often difficult to install as a retrofit into existing doors. Further, existing electric strikes generally require wired power sources (e.g., a Direct Current (DC)), which may require an electrician to run the wiring. Conventional electric strikes on their own are generally not wirelessly accessible and are unable to carry out remotely executed computing functions.

SUMMARY

An electric strike is described. One general aspect includes an electric strike including: a casing housing: a power source; a lock mechanism; circuitry powered by the power source, the circuitry being configured to authenticate a user, and electro-mechanically actuate the lock mechanism; and a rotor coupled to the lock mechanism, the rotor being powered by the power source and configured to situate the lock mechanism based on a lock state of the electric strike.

Implementations may include one or more of the following features. The electric strike where the lock mechanism includes a keeper coupled to the rotor to provide a bi-stable operation of electric strike. The electric strike where the lock state includes one of: a locked state; an unlocked state; and an intermediate state. The electric strike where energy in a spring component of the electric strike on the rotor pulls the rotor from the intermediate state to the locked state without any additional motion from the motor coupled to the rotor. The electric strike where the keeper includes a first recess and the rotor is configured to come into contact with the first recess when the keeper is in the locked state. The electric strike where the keeper includes a second recess and the rotor is configured to move freely within the second recess as the keeper is in the intermediate state. The electric strike where the keeper includes a first edge of the second recess and the rotor is configured to rest against the first edge of the second recess when the keeper is in the unlocked state. The electric strike where the keeper includes a lip that extends beyond the housing and comes into contact with an edge of a frame. The electric strike where the electric strike is usable in retrofit applications. The electric strike where the modular electronic circuit includes a wireless chip that facilitates wireless communication between the electric strike and a computing device. Implementations of the described techniques may include hardware, a method or process, or computer software on a computer-accessible medium.

One general aspect includes a lock actuation method including: broadcasting, by a wireless transmitter of a smart electric strike, a wireless authentication request to a user device, the wireless authentication request seeking authorization from a user device to unlock a lock mechanism of the electric strike; and wirelessly receiving an authentication response from the user device by the electric strike, the authentication response electro-mechanically unlocking the electric strike by moving a rotor of the electric strike to an unlock state of the electric strike. Other embodiments of this aspect include corresponding computer systems, apparatus, and computer programs recorded on one or more computer storage devices, each configured to perform the actions of the methods.

Implementations may include one or more of the following features. The method where the authentication request is transmitted using a first personal area network signal, and the authentication response is transmitted using a second personal area network signal. Implementations of the described techniques may include hardware, a method or process, or computer software on a computer-accessible medium.

One general aspect includes an electric strike including: a casing housing: a power source; a lock mechanism, the lock mechanism including a keeper configured to rotate about an axis such that a lip of the keeper extends beyond the casing housing when the lock mechanism is in a locked state; circuitry powered by the power source, the circuitry being configured to authenticate a user, and electro mechanically, actuate the lock mechanism; and a rotor coupled to the keeper of the lock mechanism, the rotor being powered by the power source and configured to situate the keeper in the locked state. Other embodiments of this aspect include corresponding computer systems, apparatus, and computer programs recorded on one or more computer storage devices, each configured to perform the actions of the methods.

Implementations may include one or more of the following features. The electric strike further including: a sliding plate with a first end and a second end, the first end being coupled to the keeper and the second end being coupled to the rotor such that when the rotor is powered by the power source, the rotor prevents the sliding plate from sliding in a direction and causes the keeper to rotate about an axis. The electric strike further including: an extension spring coupled to the rotor, the extension spring exerting a downward force that causes the rotor to rotate down towards the sliding plate after the power source has caused the rotor to rotate upwards. The electric strike where in the locked state the rotor is positioned on top of a portion of the sliding plate, where the rotor is passively pulled by the extension spring from an intermediate state into the locked state. The electric strike where the rotor is further configured to situate the rotor in the intermediate state, the intermediate causing the sliding plate to rotate out from under the rotor as the keeper is rotated. The electric strike where the rotor is further configured to situate the keeper in an unlocked state, the unlocked state positioning the rotor in a downward angled position and come into contact with an angled edge of the sliding plate. The electric strike where the keeper is configured to rotate out of the way of an internal locking mechanism. The electric strike where the keeper is rectangular in shape. Implementations of the described techniques may include hardware, a method or process, or computer software on a computer-accessible medium.

DETAILED DESCRIPTION

The present disclosure relates to electric strikes, although it should be understood that the structure and acts described herein may be applicable to other lock form factors in addition to the embodiments described herein. The electric strike in some embodiments, comprises enhanced features, such as wireless unlocking, cryptographic authentication, low power consumption, etc. The electric strike may, in some instances, advantageously be a drop-in replacement/retrofit for traditional electric strikes or existing mechanical strikes.

The electric strike disclosed herein may easily be retrofitted into custom or standard electric strike frames/cut-outs. After installation, the electric strike may constantly broadcast a wireless signal (e.g., persistently, at various intervals, etc.) via which other devices (e.g., mobile device (e.g., smartphone), server, etc.) can connect with, issue locking commands to, control, etc., the electric strike. Device may have a "wake" mechanism for broadcasting wireless signal as well. Once a secure wireless connection is made between the user device and the electric strike, the electric strike lock mechanism may unlock by turning the rotor to the unlock position. The keeper of the electric strike may then fully retract based on the rotor motion to unlock the electric strike.

Figure 1B:
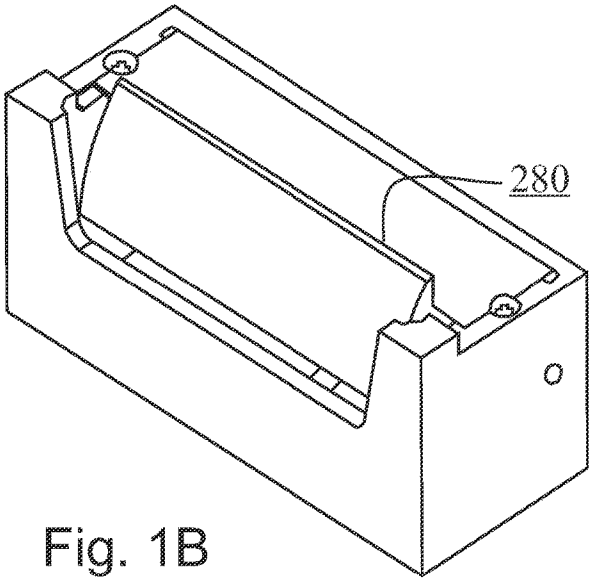
FIGS. 1A-1D depict various views of an example electric strike.
Figure 1D:
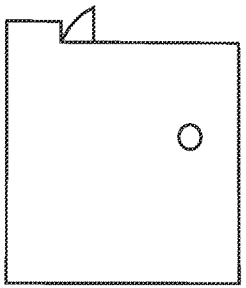
Figure 1A:
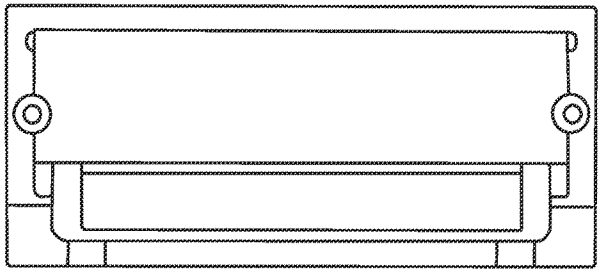
Figure 1C:
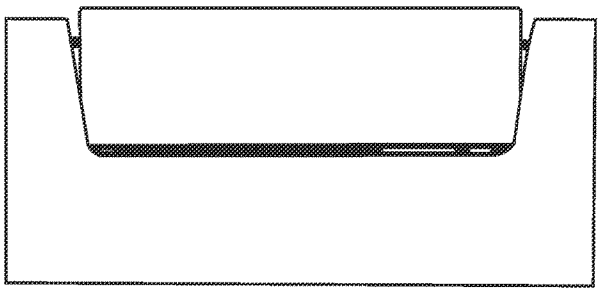

FIGS. 1A-1D depict various views of the electric strike. FIGS. 1A and 1B respectively show a top view and a perspective view of the electric strike. FIG. 1C illustrates a front view of the electric strike whereas FIG. 1D shows a right side view of the electric strike. As shown in these views, in one embodiment, the electric strike may be encompassed in a casing and presented as a single unit that can easily be installed into custom or standard electric strike frames/cut-outs.

Figure 2:
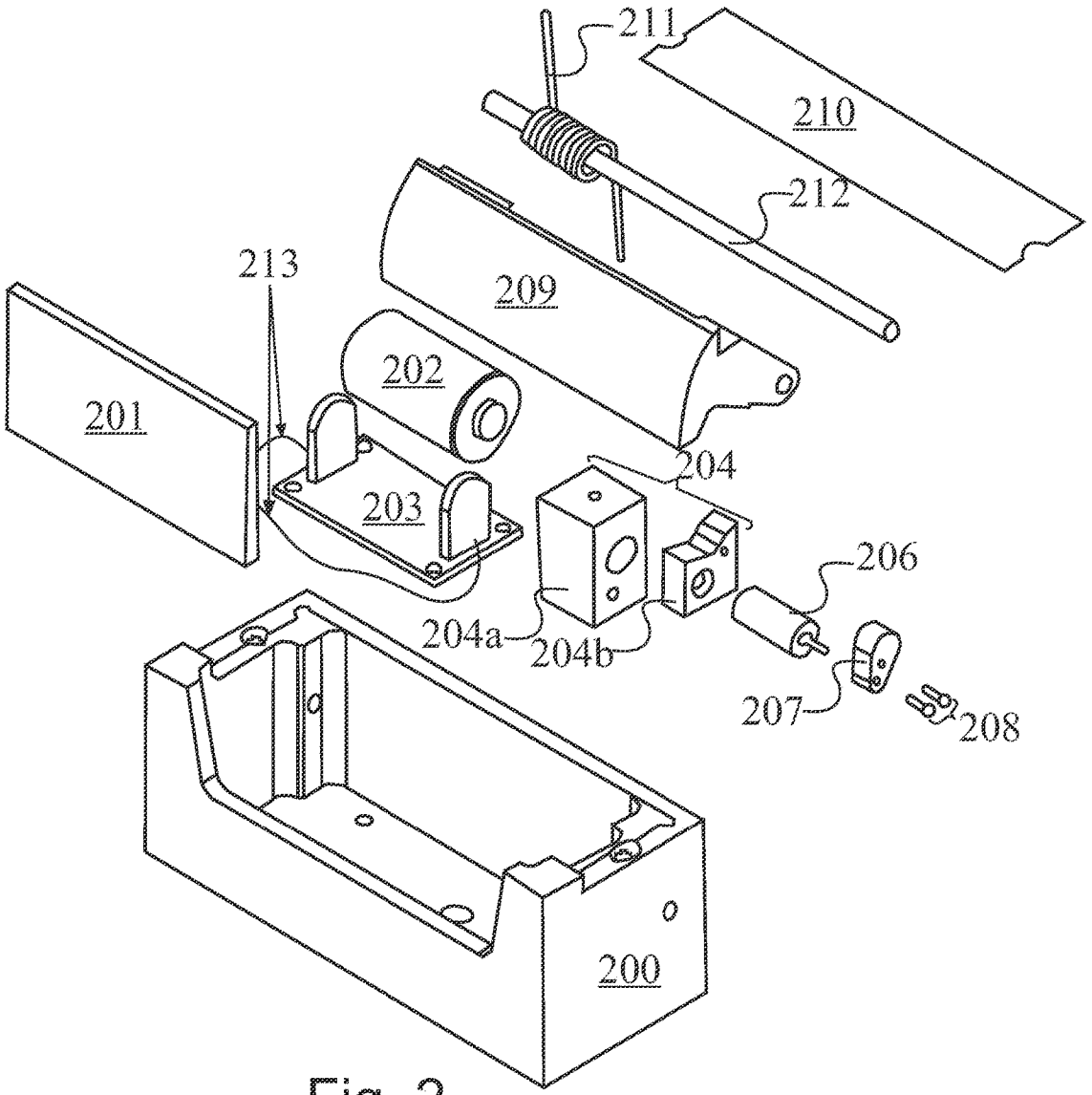
FIG. 2 depicts an exploded view of the electric strike.

FIG. 2 depicts an exploded view of the electric strike. As mentioned above, the casing 200 houses the internal electro-mechanical components of the electric strike. The casing 200 may be enclosed, at least partially, by a security plate 210. In some embodiments, when installed, the security plate 210 encloses and protects the rest of the electro-mechanical components. In some embodiments, the security plate 210 may be machined to sit flush against the top face of the casing 200. In some embodiments, the casing 200 may be rectangularly shaped although it may also assume other shapes based on desired design constrains. In some embodiments, the security plate 210 may be removable to provide access to the electro-mechanical components. In some embodiments, the casing 200 may be formed out of a durable metal or plastic that provides rigid protection to the internal electro-mechanical components. An example embodiment of the casing 200 is described in more detail with respect to FIGS. 3A-3D. In some embodiments, the casing 200 may have the same or similar outer form factor as an off-the-shelf electric strike. The casing 200 may, in some cases, be mounted on any suitable standard or custom door frame. It is noted that a front plate (not shown) may be secured to the front face (not shown) of the electric strike to allow the whole electric strike module to be mounted to the barrier during installation.

Figure 3C:
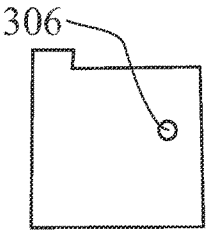
FIGS. 3A-3D show various views of the electric strike housing.
Figure 3B:
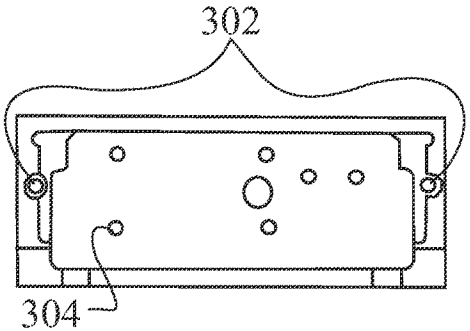
Figure 3A:
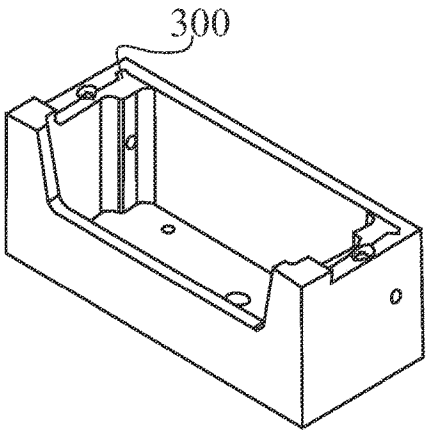

FIGS. 3A-3D depict various views of the casing 200, such as a top perspective view illustrated in FIG. 3A. In the top perspective view, a front side of the casing 200 may include a cutout portion 308 (shown in FIG. 3D) that exposes the electro-mechanical components (not shown). As shown in the top perspective view 300, the top side of the casing 200 may include an opening that exposes the interior of the casing 200 and may provide a space within the opening for the electro-mechanical components (not shown) to be situated. In some embodiments, the casing 200 may include a shoulder offset 300 as shown in FIG. 3A. The shoulder offset 300 may be included in (e.g., be integral with, attached to, etc.) (e.g., be machined onto the top of) the electric strike casing 200 to allow the security plate 210 to sit flush against the top face of the electric strike casing 200.

A top view is illustrated in FIG. 3B. In the top view, screw holes 302 and mounting holes 304 are visible in the casing 200. In some embodiments, the screw holes 302 may be adapted to receive a set of fasteners (such as a screw, nail, rod, etc.) and mount the electric strike to a barrier or frame on which the electric strike may be installed. It should be understood that the screw holes 302 are not limited to the location shown in FIG. 3B and may instead be positioned in other locations on the casing 200 to secure the casing 200 to the barrier or frame.

In some embodiments, the mounting holes 304 may be configured to receive fasteners of other electro-mechanical components (not shown). These other electro-mechanical components may be components of the casing 200 that are fitted with one or more compatible fasteners (e.g., screws, nails, pins, rods, etc.). For instance, there may be mounting holes 304 on the bottom face of the casing 200 for attaching the motor mounts 204*a* and 204*b*, the mount 203, etc. It should be understood that the mounting hole 304 positions are not limited to the positions depicted in the drawings and any appropriate mounting hole 304 location in the casing 200 is contemplated.

A right side view is illustrated in FIG. 3C showing that includes a hole 306 on the right side of the casing 200. In some embodiments, a similar hole may be present on the left side of the casing 200, although other embodiments are also contemplated. In some embodiments, the hole 306 may be a cutout portion of the side of the casing 200 that can receive a similar configured piece of one of the internal electro-mechanical components, such as the shaft 212. In some embodiments, the hole may instead by a through-aperture, depression, or other appropriate configuration, etc. that may allow a portion of the electro-mechanical components to be inserted and/or rotate freely, such as the shaft 212.

Figure 3D:
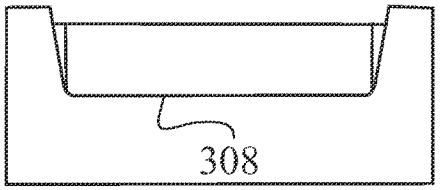

A front view is illustrated in FIG. 3D showing the cutout portion 308 on the front side of the casing 200. In some embodiments, the casing 200 may have the cutout portion 308 that exposes a surface of the keeper 209 against which the latch bolt of a door may strike/depress against when the door closes.

With reference again to FIG. 2, as shown, the electric strike includes circuitry 201 (e.g., one or more circuit boards, PCBs, etc.) connected to the power source 202 (e.g. replaceable battery) via wiring 213. In some embodiments, the circuitry 201 may include a processor having logic that controls the operation of the electric strike. The circuitry 201 may, for example, be configured to wirelessly communicate with a remote device (e.g. mobile device, server, personal computer, or the like) via a wireless network connection to receive operational instructions (to lock or unlock the electric strike), digital keys, firmware updates, etc., and/or send data (e.g., notifications, status updates, error messages, etc.).

For instance, the circuitry 201 may wirelessly broadcast a first signal to the user device that seeks to authenticate a user in order to unlock the electric strike. The user device in turn may wirelessly transmit a second signal to the electric strike authorizing the electric strike to grant the user unlock access. Using the received data and/or unlock command, the electric strike may confirm the identity of the user using the second signal and electro-mechanically unlock the electric strike.

The power source 202 shown may be a rechargeable battery (or multiple rechargeable batteries), a nonchargeable battery, or some other modular power unit that can be seamlessly coupled to the electric strike without requiring extra wiring, and/or other AC or DC power sources to provide electric power to the electric strike. In some embodiments, the circuitry 201 may be efficiently configured/optimized to conserve energy, thus allowing the electric strike to operate over extended periods of time (e.g. typically 5 years or more) without having to recharge, service and/or replace the power source.

As shown in the example depicted in FIG. 2, the mount 203 for the power source 202 may house the power source 202 and may be wired to the components of the electric strike requiring electrical energy, such as the circuitry 201, motor 206, etc.

Figure 8:
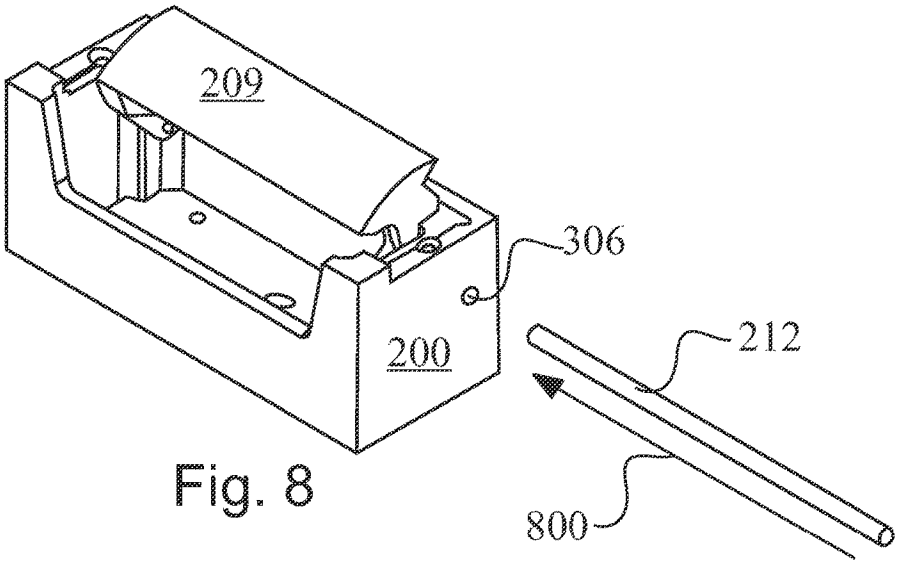
FIG. 8 depicts an example coupling of the shaft, the keeper, and the housing.
Figure 9B:
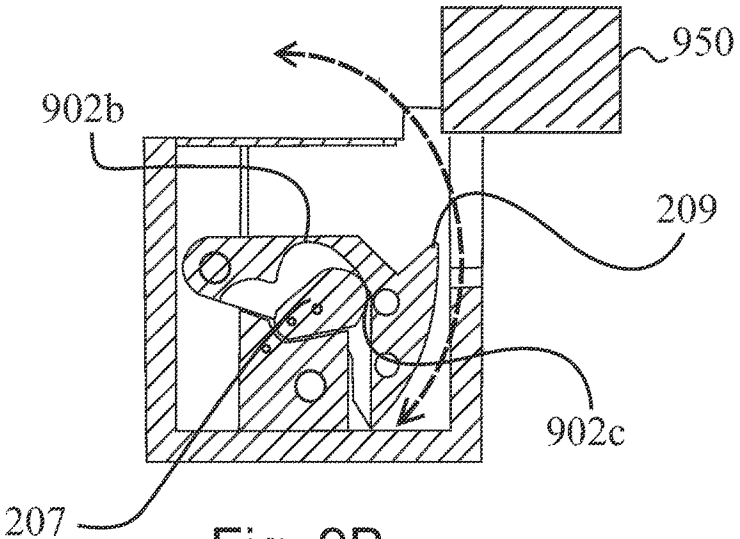
FIGS. 9A-9C show cutaway views of the internal locking mechanism in a locked state, intermediate state, and an unlocked state according to some embodiments.
Figure 9C:
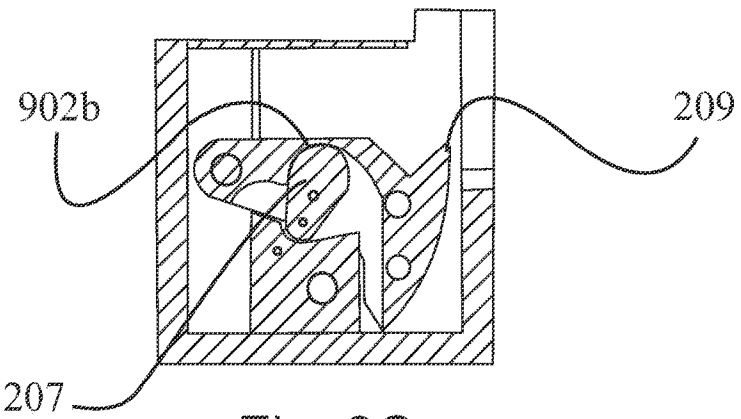
Figure 9A:
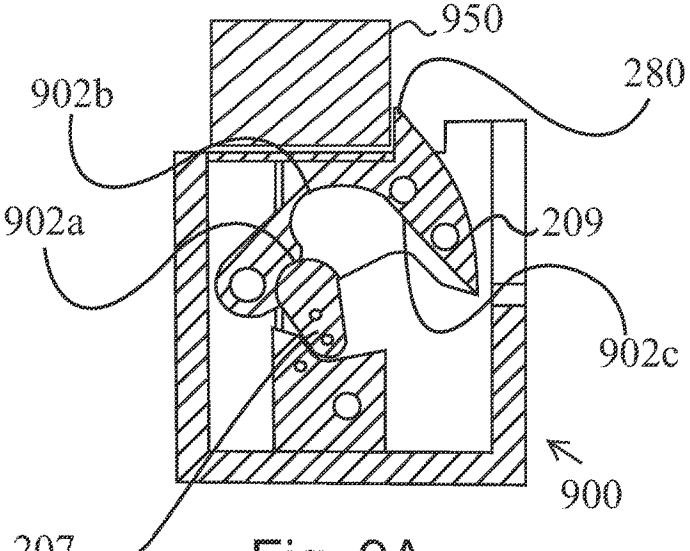

The keeper 209 may be configured to rotate about a shaft 212 and cause the electric strike to lock and/or unlock when the edge of the keeper extends beyond the security plate and comes into contact with a portion of a door jam, as shown in more detail in FIGS. 9A-9C. The torsion element 211, may extend a force on the keeper 209 when the keeper is in different positions, causing the keeper 209 to rotate about the shaft 212 into different positions, as show in more detail with respect of FIGS. 9A-9C. In some embodiments the torsion element 211 may be a spring component or an extension spring as described elsewhere herein. In further embodiments, the torsion element 211 could instead be a magnetic component (or set of magnetic components) that exert pressure towards and away from each other that causes the keeper 209 to rotate. The torsion element 211 may be any type of material capable of exerting a force on the keeper 209 to push and/or pull the keeper 209 into different positions, such as a spring, stretchable material, magnet, etc. In some implementations, the torsion element 211 may use potential energy stored in the torsion element 211, such as a spring or other material. In further implementations, a separate motor mechanism (not shown) may cause the keeper 209 to move, rather than the torsion element 211. The keeper 209, as well as the torsion element 211 (such as a spring, etc.) and the shaft 212 are discussed in more detail with reference to FIGS. 8 and 9.

The motor 206 of the electric strike, which is powered by the power source 202, may be fitted into the motor mount 204. The motor mount 204 may, in some embodiments, comprise a first motor mount 204*a* and a second motor mount 204*b* depending on the design desired. In other embodiments, the first motor mount 204*a* and the second motor mount 204*b* may be integral or may be separate components that are attached together to satisfy other design constraints (e.g., form factor constraints).

Figure 4:
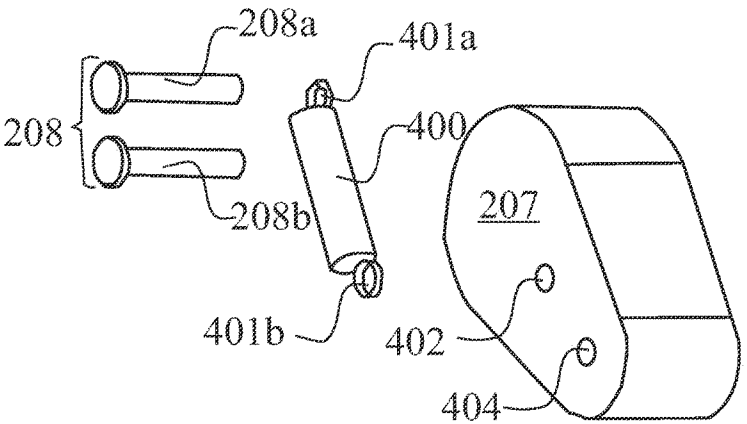
FIGS. 4, 5 and 6 describe a coupling of the rotor to the motor and motor housing.

The rotor 207 may be coupled to the motor 206 as illustrated with reference to FIGS. 4, 5 and 6. As shown in FIG. 4, the fasteners (e.g., pins, screws, or the like) 208 may each be fastened to corresponding fastening elements (e.g., may each be inserted into spring loops 401*a* and 401*b*) to secure the extension spring 400 (or other appropriate torsion element) of the rotor 207. For example, fastener 208*a* may extend through the loop 401*a* and secure into fastening hole 402.

Figure 5:
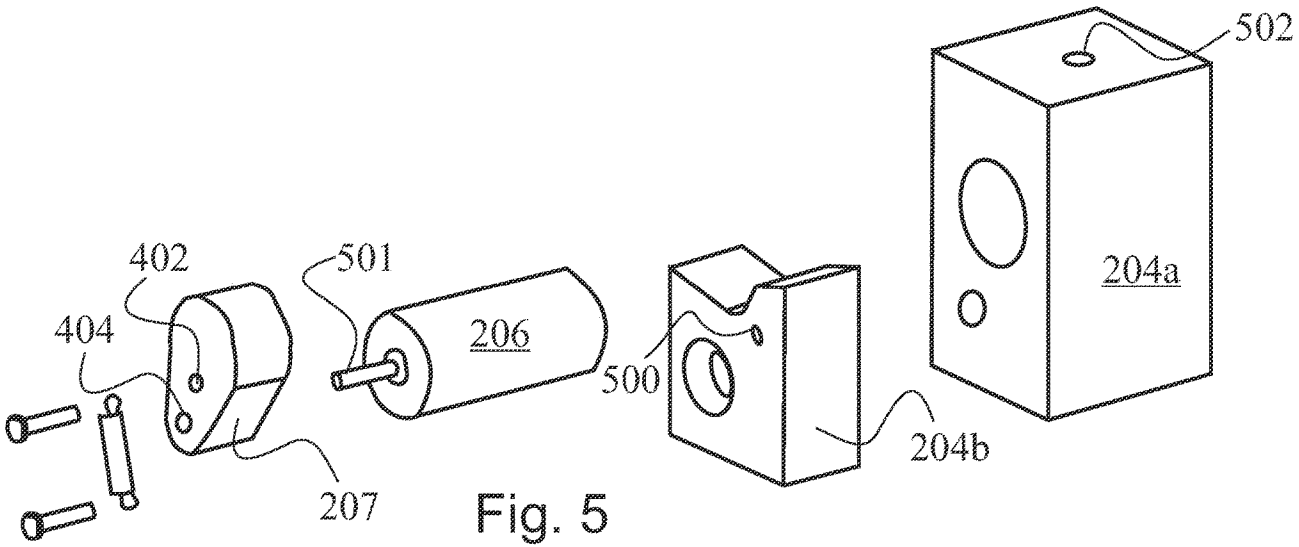

FIG. 5 shows how similarly, fastener 208*b* may be inserted into and/or extend through spring loop 401*b* and secure into fastening hold 500 of the second motor mount 204*b*. The motor shaft 501 may be coupled to the rotor 207 via hole 404 with the motor 208 being held in place within the first motor mount 204*a* using a suitable fastener, such as the cavity/hole 500.

Figure 6:
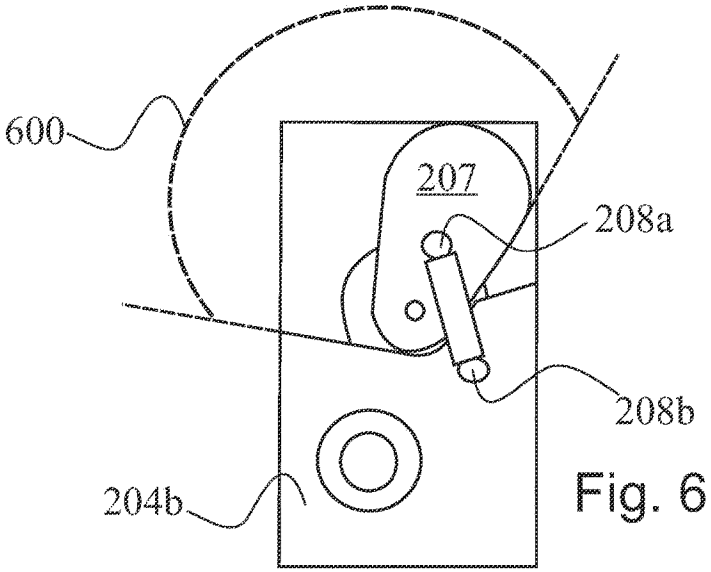

FIG. 6 shows an example range of motion 600 of the coupling of the first motor mount 204 to the second motor mount 205. As shown, in some embodiments, the coupling of the first motor mount 204 and the second motor mount 205 can limit the range of motion 600 of the rotor 207.

Figure 7C:
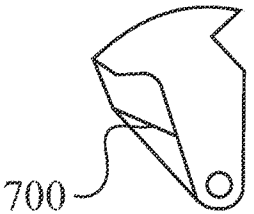
FIGS. 7A-7D depict various views of the keeper.
Figure 7B:
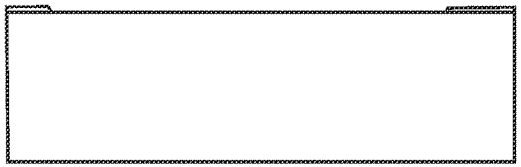
Figure 7A:
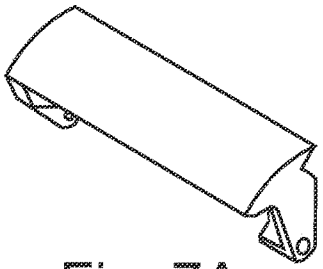
Figure 7D:
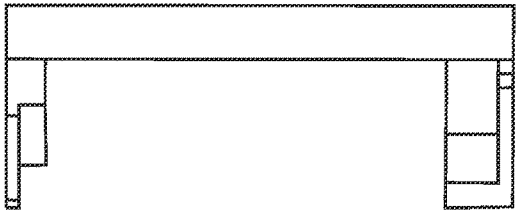

FIGS. 7A-7D depict various views of the keeper. FIG. 7A shows a perspective view of the keeper 209, whereas FIGS. 7B, 7C and 7D respectively depict a top view, a right side view, and a front view of the keeper 209 respectively. Referring back to FIG. 2, a coil of the torsion element 211 is shown as surrounding (e.g., wrapping around) the shaft 212. This may allow one of the ends of the torsion element 211 to rest on the shoulder 700 of the keeper 209 shown in FIG. 7C with the other end of the torsion element 211 resting on an end of the casing 200. The torsion element 211 may provide a constant force that causes the keeper 209 to return to a default steady state (a locked state) after being in an unlocked state/opened.

FIG. 8 depicts an example assembly of the shaft 212, the keeper 209 and the casing 200. As can be seen in the figure, the shaft 212 may be passed 800 through the through a first hole 306 of the casing 200 and then into and through a corresponding hole on the keeper 209. The shaft 212 may further be passed into a corresponding second hole of the keeper 209 and then into another hole 306 of the casing 200. In this example, the first and second holes 306 of the casing 200 align with the first and second holes of the keeper 209, which secures the keeper 209 in place while allowing it to rotate around an axis extending along the centerline of the shaft 212. The keeper 209 may rotate about the shaft, allowing the keeper 209 to pivot/rotate along the shaft 212 and cause the keeper 209 to align in different positions as discussed in more detail with respect to FIGS. 9A-9C.

FIGS. 9A-9C show cutaway views of the internal locking mechanism 900 in different positions including at least a locked state, intermediate state, and an unlocked state. As shown in FIG. 9A, a lip 280 of the latch 209 retains the keeper bolt 950 locked behind the keeper 209 when the electric strike is locked to prevent a door (or other device) from opening.

In FIG. 9A, the rotor 207 may be situated into three positions, in each of which a lobe of the rotor contacts a different place on an inner surface of the keeper 209. The inner surface of the keeper 209 may be profiled such that contact between the lobe of the rotor 207 on the profile of the keeper 209 is different in each of the positions, thus having a different effect on the keeper 209. The foregoing positions on the latch 209 include a locked position 902*a* corresponding to a locked state of the lock, an unlocked position 902*b* corresponding to an unlocked state of the lock, and an intermediate position 902*c* corresponding to an intermediate state of the lock.

In the locked state of FIG. 9A, the rotor 207 is positioned upward such that the lobe couples into a first recess of the profiled inner surface. In this position 902*a*, the rotor 207 blocks the keeper 209 from retracting downward back into the casing, thus forcing the lip 280 of the keeper 209 to protrude outwardly from the top surface of the casing to block the bolt 950, thus locking a door (or other device) in which the latch bolt is 950 is installed.

When the motor 206 moves the rotor 207 to the unlocked position in FIG. 9B, the lock is placed in the unlocked state where the spring-loaded keeper 209 (caused by the torsion element 211) can retract fully into the casing. This frees the door to open by releasing the keeper bolt 950 from the lip 280 of the keeper 209. In this position, the lobe of the rotor 207 is positioned along the curved surface 902*c* of the inner surface of the keeper 209 that increasingly opposes the surface 902*a* as it extends toward the front of the lock.

When the keeper 209 is fully extended to its position shown in FIG. 9A, the rotor 207 returns to its position shown in FIG. 9A where the rotor 207 rests along the position 902*a* of the keeper 209.

In some cases, the rotor 207 can be turned by the motor 206 into the intermediate position shown in FIG. 9C, which places the lock in an intermediate state. In the intermediate state of FIG. 9C, the rotor 207 is positioned to couple with a second recess 902*b* of the inner surface of the keeper 209 that is adjacent and in front of the first recess. If the keeper 209 is extended again into the position shown in FIG. 9A, the force exerted by the extension spring 400 on the rotor 207 pulls the rotor 207 from this intermediate position 902*c* to the locked position 902*a* without having to activate/provide additional torsion by the motor 206. This allows the electric strike to remain secure after the keeper 209 is fully extended (FIG. 9A) even if the keeper 209 is purposely held down during the electro-mechanical relock described above. In some embodiments, the electric strike may transition from the intermediate state to the locked state without any additional motion from the motor coupled to the rotor 207.

As can be seen in FIG. 9B, the keeper 209 can rotate around the shaft between the above-discussed positions.

The bi-stable design of the lock advantageously allows the lock to relock when needed, or stay open when needed.

In some embodiments, the electric strike electro-mechanically and automatically relocks after a certain time after being in the unlocked state. This "certain time" may be a design parameter that can be modified by reprogramming the control logic residing on the memory of the circuitry 201 or transmitted as part of the wireless connection.

Figure 10A:
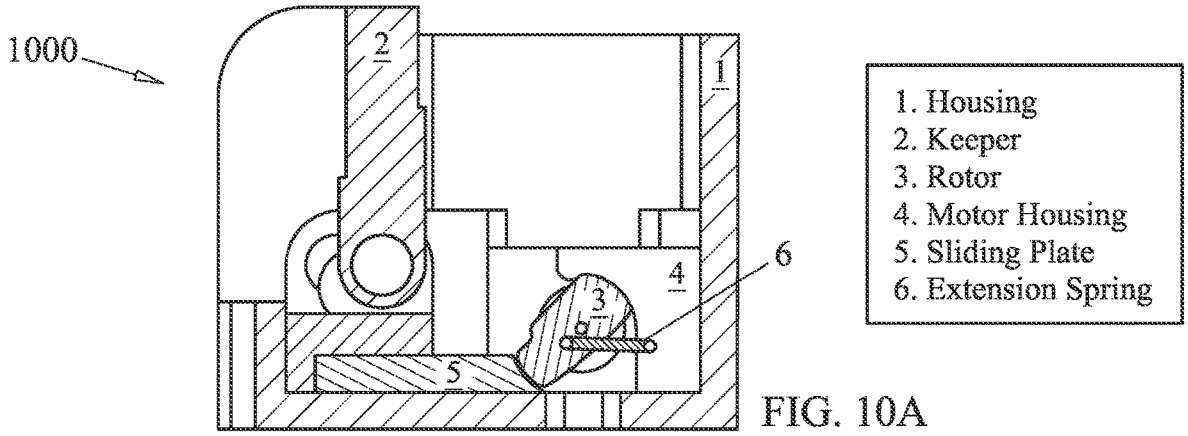
FIGS. 10A-10C show cutaway views of an internal locking mechanism in a locked state, intermediate state, and an unlocked state according to further embodiments.
Figure 10B:
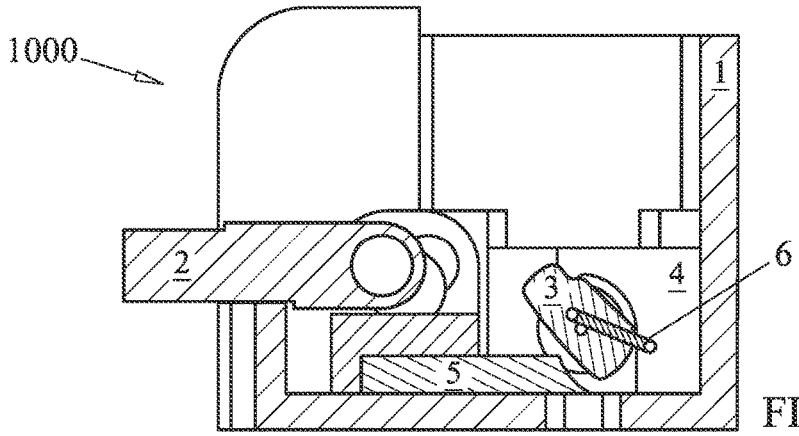
Figure 10C:
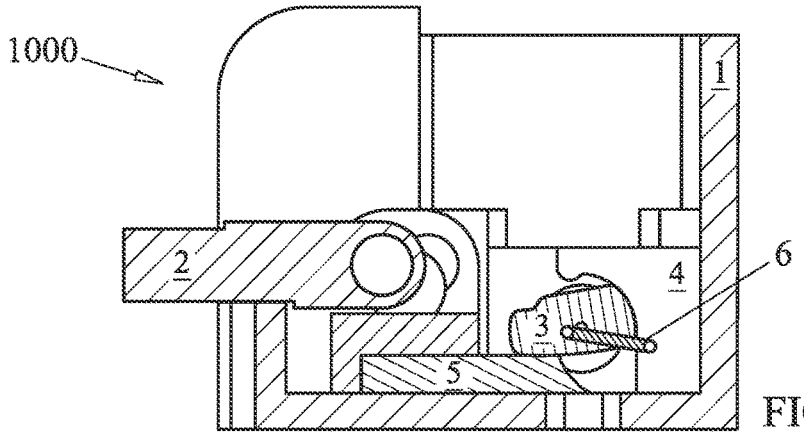

FIGS. 10A-10C show cutaway views of an internal locking mechanism 1000 having an analogous design to that of the internal locking mechanism 900 depicted in FIGS. 9A-9C. As with FIGS. 9A-9C, FIGS. 10A-10C show the internal locking mechanism in a locked state, intermediate state, and an unlocked state according to further embodiments. As shown in FIG. 10A, in the unlocked state, the rotor 3 comes into contact with the sliding plate 5 and the extension spring 6 retains the rotor 3 in that positions. The rotor 3 may rest in a downward angled position and the front portion of the rotor may come into contact with an angled edge of the sliding plate 5. The extension spring 6 may be connected to the rotor 3 and the motor housing 4 and the motor housing 4 may house a motor as described elsewhere herein. In the unlocked state, the keeper 2 is in the locked position and the sliding plate 5 is in the unlocked position and in contact with the rotor 3. In some embodiments, the sliding plate may have a first edge that is angled to slide underneath the rotor as the sliding plate moves from state to state.

As show in FIG. 10B, the motor may cause the rotor 3 to rotate about an axis. This allows the sliding plate 5 to move in a direction towards the rotor 3. As the rotor moves away from the sliding plate into the intermediate position, the keeper 2 may move into a locked position causing the locking pate 5 to move towards and under the rotor 3, because the rotor 3 is rotated upwards and out of the way above the sliding plate 5. As shown in FIG. 10C, the rotor 3 may then come to rest on a top surface of the sliding plate 5 as the rotor 3 is reset from the torsion applied by the extension spring 6. In the locked state, the rotor 3 may stay in this position using the torsion from the extension spring 6 until the sliding plate 5 is positioned back in the unlocked state as show in FIG. 10A.

While both the internal locking mechanism 900 and the internal locking mechanism 1000 provide the same or similar functionality, the internal locking mechanism 1000 includes some additional/alternative components and/or features. For example, the keeper (2) rotates (e.g., 90 degrees) out of the way instead of retracting like in the internal locking mechanism 900. Also, the rotor (3) geometry/dimensions correspond with the keeper (2), and thus has different geometry/dimensions to that of the keeper of the internal locking mechanism 900. Further, the internal locking mechanism 1000 includes a sliding plate mechanism as described above.

It should be understood that the description of the internal locking mechanism 900 applies to the internal locking mechanism 1000 to the extent that the structure, acts, features, and benefits described do not conflict. As such, they are not repeated here for the purposes of brevity.

In some embodiments, the electric strike may be a smart electric strike and may include a wireless transmitter coupled to the power source. The wireless transmitter may be configured to send a wireless authentication request to a user device separate from the electric strike and the wireless authentication request may seek authorization from the user device to unlock a lock mechanism of the electric strike. The wireless transmitter may be further configured to receive an authentication response from the user device and the authentication response may electro-mechanically cause the smart electric strike to by unlocked by moving the rotor of the electric strike to the unlocked state.

The foregoing description, for purposes of explanation, has been provided with reference to various embodiments and examples. However, the illustrative discussions above are not intended to be exhaustive or limited to the precise forms of the electric strike disclosed herein. Many modifications and variations are possible in view of the above teachings. The various embodiments and examples were chosen and described in order to best explain the principles upon which the design of the electric strike is based. Practical applications of the above concepts by one skilled in the art that utilize the above innovative technology with various modifications as may be suited to the particular use are contemplated.

What is claimed is:

1. An electric strike comprising:

casing housing components of the electric strike, including:

a power source;

a lock mechanism;

a modular electronic circuit powered by the power source, the modular electronic circuit being configured to wirelessly authenticate a user and electromechanically acuate the lock mechanism;

a rotor coupled to the lock mechanism, the rotor being powered by the power source and configured to situate the lock mechanism based on a lock state of the electric strike;

wherein the lock mechanism includes a keeper coupled to the rotor to provide a bi-stable operation of the electric strike, wherein the locked state includes one of: a locked state, an unlocked state, and an intermediate state; and wherein the energy of a torsion element is configured to pull the rotor from the intermediate state without any additional motion from a motor coupled to the rotor.

2. The electric strike of claim 1, wherein the keeper is configured to rotate about an axis such that a lip of the keeper extends beyond the casing housing when the lock mechanism is in the locked state.

3. The electric strike of claim 1, wherein the keeper is configured to rotate out of the way of an internal locking mechanism.

4. The electric strike of claim 1, wherein the rotor is configured to situate the keeper in the unlocked state.

5. The electric strike of claim 1, wherein the torsion element is a spring component.

6. The electric strike of claim 1, wherein the torsion element exerts a downward force that causes the rotor to rotate down towards a sliding plate after the power source has caused the rotor to rotate upwards.

7. The electric strike of claim 6, wherein the sliding plate has a first end and a second end, the first end being coupled to the keeper and the second end being coupled to the rotor such that when the rotor is powered by the power source, the rotor prevents the sliding plate from sliding in a direction and causes the keeper to rotate about an axis.

8. The electric strike of claim 7, wherein in the locked state the rotor is positioned on top of a portion of the sliding plate, wherein the rotor is passively pulled by the torsion element from an intermediate state into the locked state.

9. The electric strike of claim 8, wherein the rotor is further configured to situate the rotor in the intermediate state, the intermediate causing the sliding plate to rotate out from under the rotor as the keeper is rotated.

10. The electric strike of claim 7, wherein the rotor is further configured to situate the keeper in the unlocked state, the unlocked state positioning the rotor in a downward angled position and come into contact with an angled edge of the sliding plate.

11. The electric strike of claim 1, wherein the modular electronic circuit include a wireless chip to communicate with a smartphone of a user and authenticate the user, via the smartphone of the user, as a condition to electromechanically actuate the lock mechanism.

12. An electric strike comprising:

casing housing components of the electric strike, including:

a power source;

a lock mechanism;

a modular electronic circuit including a processor, logic, and a wireless communication chip, the modular electronic circuit powered by the power source, the modular electronic circuit being configured to wirelessly communicate with a smartphone of a user and authenticate the user as a condition to electromechanically actuate the lock mechanism; and a rotor coupled to the lock mechanism, wherein the lock mechanism includes a keeper coupled to the rotor to provide a bi-stable operation of the electric strike, the rotor being powered by the power source and configured to situate the lock mechanism based on a lock state of the electric strike, wherein the lock state includes one of: a locked state, an unlocked state, and an intermediate state; and wherein energy in a torsion element of the electric strike on the rotor pulls the rotor from the intermediate state to the locked state without any additional motion from a motor coupled to the rotor.

13. The electric strike of claim 12, wherein the keeper includes a lip that extends beyond the housing and comes into contact with an edge of a frame.

14. The electric strike of claim 12, wherein the keeper includes a recess and the rotor is configured to come into contact with the recess when the keeper is in the locked state.

15. An electric strike comprising:

casing housing components of the electric strike, including:

a power source;

a lock mechanism;

a modular electronic circuit including a processor, logic, and a wireless communication chip, the modular electronic circuit powered by the power source, the modular electronic circuit being configured to wirelessly communicate with a smartphone of a user and authenticate the user as a condition to electromechanically actuate the lock mechanism; and a rotor coupled to the lock mechanism, wherein the lock mechanism includes a keeper coupled to the rotor to provide a bi-stable operation of the electric strike, the rotor being powered by the power source and configured to situate the lock mechanism based on a lock state of the electric strike, wherein the lock state includes one of: a locked state, an unlocked state, and an intermediate state; and wherein the keeper includes a recess and the rotor is configured to move freely within the recess as the keeper is in the intermediate state.

16. The electric strike of claim 15, wherein the keeper includes an edge of the recess and the rotor is configured to rest against the edge of the recess when the keeper is in the unlocked state.

* * * * *